United States Patent [19]

Matsubara

[11] Patent Number: 4,769,925

[45] Date of Patent: Sep. 13, 1988

[54] DEVICE FOR PREVENTING RESINOUS CONDENSATE DROPPING FOR USE IN PAINT DRYING OVEN

[75] Inventor: Izuru Matsubara, Tokyo, Japan

[73] Assignee: Taikisha Ltd., Tokyo, Japan

[21] Appl. No.: 75,623

[22] Filed: Jul. 20, 1987

[51] Int. Cl.[4] ..... F26B 19/00

[52] U.S. Cl. ..... 34/243 C; 98/115.2; 118/326; 118/634; 118/DIG. 7

[58] Field of Search ..... 34/243 C; 98/115.2; 126/299 R, 299 C, 299 D, 299 E, 299 F; 118/326, DIG. 7, 634

[56] References Cited

U.S. PATENT DOCUMENTS 2,486,877 11/1949 Ransburg et al. ..... 118/DIG. 7 X
4,231,289 11/1980 Oomicert ..... 118/DIG. 7 X
4,276,064 6/1981 Gerdes ..... 98/115.2 X
4,290,348 9/1981 Morgan et al. ..... 98/115.2
4,375,487 3/1983 Huber ..... 98/115.2 X

*Primary Examiner*—Steven E. Warner
*Attorney, Agent, or Firm*—Webb, Burden, Ziesenheim & Webb

[57] ABSTRACT

A device for preventing resinous condensate dropping for use in a paint drying oven. The device includes a trough extending along an upper edge of a wall opening for passage of articles under drying treatment, to receive condensates of residual tar and guide them to laterally outwardly of the articles. The trough has a slate or other water-retentive member applied to an undersurface thereof to prevent formation of condensates on the undersurface. A glass wool member is interposed between the trough and slate to act as heat insulator.

8 Claims, 2 Drawing Sheets

DEVICE FOR PREVENTING RESINOUS CONDENSATE DROPPING FOR USE IN PAINT DRYING OVEN

BACKGROUND OF THE INVENTION

The present invention relates to a paint drying oven for drying paint applied to various articles such as automobile bodies or casings for electrical appliances. More particularly, the invention relates to a device for preventing resinous condensate dropping for use in a paint drying oven, comprising troughs for receiving condensates of residual tar formed on walls of the oven.

The troughs for receiving condensates of residual tar formed on walls of the oven are provided in order to prevent the condensates from dropping to the articles under drying treatment. Generally, such troughs are disposed on or adjacent upper edges of openings defined in oven walls for passage of the articles. However, no measure has been taken heretofore with regard to condensates of residual tar formed on outer surfaces of the troughs per se.

The condensates formed on the outer surfaces of the troughs could drop to the articles passing through the openings, which results in inferior products having unsatisfactory painting.

It has been conventional practice to avoid this inconvenience by means of frequent maintenance operations to remove the condensates from the outer surfaces of the troughs.

SUMMARY OF THE INVENTION

The object of the present invention is to provide a device for preventing resinous condensate dropping for use in a paint drying oven, which is effective to prevent formation of the resinous condensates on outer surfaces of troughs provided for receiving downflows of resinous condensates.

In order to achieve the above object, a device for preventing resinous condensate dropping comprises a trough mounted on a lower end of each of walls of the paint drying oven defining an opening for passage of articles under drying treatment, for receiving condensates of residual tar formed on surfaces of the wall, and a water-retentive member provided on at least an undersurface of the trough and acting as means for preventing formation of condensates of residual tar. This construction has the following function and effect:

It has been found through researches on the condensation of residual tar that the moisture in the oven first condensates and forms wet surfaces on the walls and troughs for example, and the residual tar in the oven mixes into the water on the wet surfaces thereby to form condensates of residual tar.

The condensates of residual tar, therefore, can be effectively prevented from forming on outer surfaces of the troughs by applying a water-retentive material to the outer surfaces of the troughs, since the water-retentive material will act to avoid formation of the wet surfaces.

This provision eliminates inferior products heretofore encountered due to dropping thereto of the condensates of residual tar formed on the outer surfaces of the troughs. Thus the paint drying oven now outputs high quality products with high efficiency. The maintenance operation for removing the resinous condensates is greatly lessened, which results in reduction of maintenance costs.

It is conceivable to provide the water-retentive material substantially over an entire wall area to prevent the formation of resinous condensates thereby to dispense with the troughs. But such an extensive modification has the drawback in equipment cost and would require great cost and labor for changing the water-retentive material.

According to the present invention, the water-retentive material is applied to the outer surfaces of the troughs without necessitating the water-retentive material to be applied to the entire wall area of the oven. Thus, the improvement is simple and yet has the advantage of low equipment cost. The water-retentive material may be changed readily with a simple maintenance operation.

Other features and advantages of the invention will be apparent from the description of the preferred embodiment to follow.

DESCRIPTION OF THE PREFERRED EMBODIMENT

An embodiment of the present invention will be described hereinafter with reference to the drawings.

Figure 1:
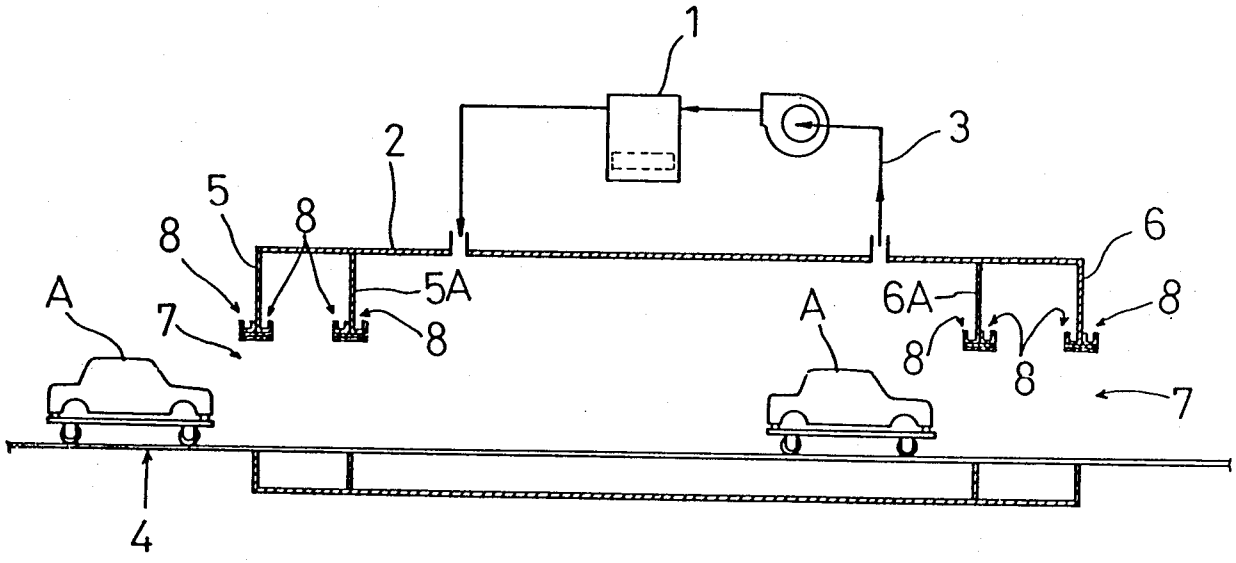
FIG. 1 is an overall view of a paint drying oven including a device for preventing resinous condensate dropping according to the present invention.

FIG. 1 shows a paint drying oven for drying paint applied to articles A such as automobile bodies. The drying oven comprises a hot air generator 1, a tunnel-like drying chamber 2, a hot air recirculation line 3 for recirculating hot air generated at the hot air generator 1 through the drying chamber 3, and a conveyor 4 for transporting the articles A through the drying chamber 2.

Figure 2:
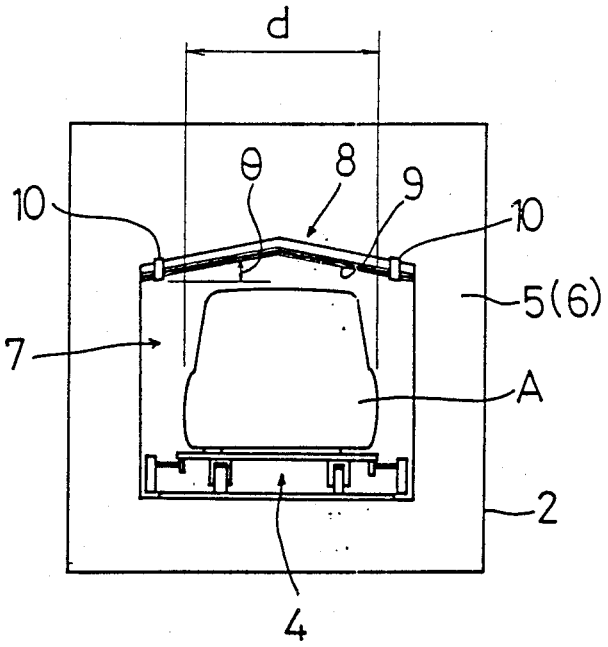
FIG. 2 is a schematic view showing inlet and outlet openings of the paint drying oven.

As shown in FIGS. 1 and 2, the drying chamber 2 has a front wall 5, a rear wall 6, a front partition wall 5A disposed adjacent the front wall 5, and a rear partition wall 6A disposed adjacent the rear wall 6. These walls 5, 6, 5A and 6A define openings 7 for allowing the articles A to enter and leave the drying chamber 2. Troughs 8 are provided along upper edges of the respective openings 7 to receive resinous condensates of residual tar formed on and flowing down surfaces of these walls.

Since the front and rear walls 5, 6 and the front and rear partition walls 5A, 6A adjacent thereto define the openings 7, residual tar tends to condensate in large quantities on the surfaces of these walls. The troughs 8 are provided as described above to receive descending condensates of residual tar, which prevents the condensates from dropping to the articles passing through the openings 7.

Each trough 8 extends over an entire width of opening 7, sloping from the center to both lateral sides of opening 7 with a gradient 0, to allow the condensates of residual tar to flow down to the lateral sides. The condensates guided by the trough 8 to flow to the lateral sides of opening 7 are collected in suitable containers.

Figure 3:
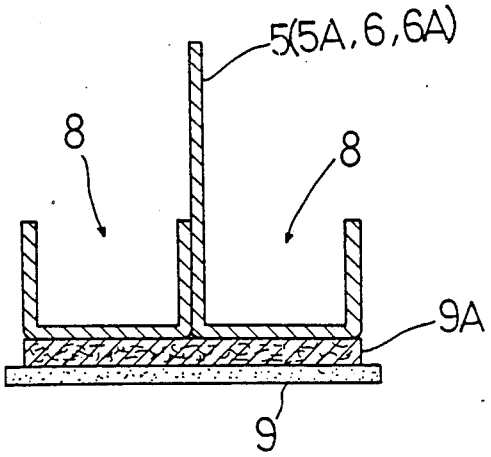
FIG. 3 is an enlarged sectional view of a principal portion of the device for preventing resinous condensate dropping.

As shown in FIG. 3, each trough 8 is provided, on an outer bottom surface thereof where the residual tar tends to condense, with a slate 9 acting as a water-retentive condensation preventing member.

More particularly, the slate 9 is applied to the outer surface of each trough 8 where the residual tar tends to condense, in view of the fact that the condensation of residual tar is caused by wet surfaces resulting from condensation of moisture in the drying chamber. The water-retaining function of the slate 9 prevents formation of the wet surface per se, thereby to avoid condensation of the residual tar on the outer surface of the trough 8. This provision eliminates possibility of the condensates of residual tar formed on the outer surface of the trough 8 dropping to the articles A passing through the openings 7, which would results in inferior products. The slates may of course be provided on lateral surfaces of the trough 8 also.

As shown in FIG. 3, a glass wool material 9A is interposed between the trough 8 and the slate 9. This allows only a little heat conduction between the trough 8 or the walls of the oven and the slate 9. As a result, the surface temperature of the slate 9 does not become very much lower than the surrounding chamber temperature, thereby restricting condensation of moisture, and hence formation of condesates of residual tar on surfaces of the slate 9.

The slate 9 extends substantially over an entire length of the trough 8 to act as a member for preventing condensation of residual tar. The slate 9 is removably secured to the trough 8 by clamps 10 at positions in outward regions of the openings 7 and with a spacing greater than a width d of the articles A in transportation. This construction enables change of the slate 9.

Since the clamps 10 are disposed outwardly of the width d of the articles A, condensates of residual tar formed on outer surfaces of the clamps 10 do not drop to the articles A.

The slate 9 is changed when it has deteriorated or when wet surfaces are formed thereon as a result of excessive water retention. Tests have been conducted by attaching commercially available slates to the outer surface of the trough 8. After three weeks of use, the slate surfaces became slightly discolored but dropping of residual tar condensates did not take place. Thus, it has been found that the slates maintain the desired function over a long period without changing or maintenance work.

Incidentally, where the slate or other waterretentive member for preventing condensation of residual tar was not employed, it was necessary to wipe the residual tar condensates off the outer surfaces of the trough 8 at least once a day.

In the foregoing embodiment the slates are used as the member for preventing condensation of residual tar, but the slates may be replaced by asbestos or other materials having water-retention and a certain degree of heat resistance.

The shape and construction of trough 8 and the manner of attaching the member 9 for preventing condensation of residual tar may be varied in many ways within the scope of this invention.

The device for preventing dropping of residual tar condensates according to the present invention may be provided at other locations susceptible to the residual tar condensates, besides the locations noted hereinbefore.

What is claimed is:

1. A device for preventing resinous condensate dropping for use in a paint drying oven, comprising a trough mounted on a lower end of each of walls of said paint drying oven defining an opening for passage of articles under drying treatment, for receiving condensates of residual tar formed on surfaces of the wall, and a water-retentive member provided on at least an undersurface of said trough and acting as means for preventing formation of condensates of residual tar.

2. A device for preventing resinous condensate dropping as claimed in claim 1 wherein said means for preventing formation of condensates of residual tar comprises a slate.

3. A device for preventing resinous condensate dropping as claimed in claim 1 wherein said means for preventing formation of condensates of residual tar comprises asbestos.

4. A device for preventing resinous condensate dropping for use in a paint drying oven, comprising a trough mounted on a lower end of each of walls of said paint drying oven defining an opening for passage of articles under drying treatment, for receiving condensates of residual tar formed on surfaces of the wall, a water-retentive member provided on at least an undersurface of said trough and acting as a means for preventing formation of condensates of residual tar, and a heat insulating member interposed between said trough and said means for preventing formation of condensates of residual tar.

5. A device for preventing resinous condensate dropping as claimed in claim 4 wherein said heat insulating member is formed of glass wool.

6. A device for preventing resinous condensate dropping for use in a paint drying oven, comprising a trough mounted on a lower end of each of walls of said paint drying oven defining an opening for passage of articles under drying treatment, for receiving condensates of residual tar formed on surfaces of the wall, and a water-retentive member removably attached by clamps to at least an undersurface of said trough and acting as means for preventing formation of condensates of residual tar.

7. A paint drying oven including a device for preventing resinous condensate dropping as claimed in claim 6 wherein said walls each having said trough extend transversely of a direction of transport of the articles under drying treatment, said clamps acting to attach said means for preventing formation of condensates of residual tar to said trough with a span greater than a width of said articles under drying treatment.

8. A paint drying oven including a device for preventing resinous condensate dropping as claimed in claim 6 wherein a heat insulating member is interposed between said trough and said means for preventing formation of condensates of residual tar.

* * * * *